US010635021B1

(12) United States Patent
Fujita et al.

(10) Patent No.: US 10,635,021 B1
(45) Date of Patent: Apr. 28, 2020

(54) IMAGE FORMING METHOD

(71) Applicant: Konica Minolta, Inc., Tokyo (JP)

(72) Inventors: Michiyo Fujita, Tokyo (JP); Ryuichi Hiramoto, Hyogo (JP); Tomoko Mine, Tokyo (JP); Kaori Matsushima, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/567,916

(22) Filed: Sep. 11, 2019

(30) Foreign Application Priority Data

Oct. 22, 2018 (JP) ..... 2018-198341

(51) Int. Cl.
*G03G 15/00* (2006.01)
*G03G 15/08* (2006.01)

(52) U.S. Cl.
CPC ..... *G03G 15/0822* (2013.01); *G03G 15/5029* (2013.01); *G03G 2215/00805* (2013.01)

(58) Field of Classification Search
CPC ..... G03G 15/0822; G03G 15/5029; G03G 2215/00805
See application file for complete search history.

(56) References Cited

U.S. PATENT DOCUMENTS 7,945,177 B2 * 5/2011 Tomizawa ..... G03G 9/0821 399/389
10,261,434 B2 * 4/2019 Fujita ..... G03G 15/01

FOREIGN PATENT DOCUMENTS

JP H01200985 A 8/1989
JP 2013178452 A 9/2013

* cited by examiner

*Primary Examiner* — Hoang X Ngo
(74) *Attorney, Agent, or Firm* — Lucas & Mercanti, LLP

(57) ABSTRACT

The present invention provides an image forming method for forming a decorated image having a resin layer and a powder contacted with each other, the method including: forming a resin layer on a recording medium; and supplying a powder onto the recording medium, in which the recording medium has a surface with an arithmetic mean height Sa of 1.000 or more.

18 Claims, 5 Drawing Sheets

IMAGE FORMING METHOD

CROSS REFERENCE TO RELATED APPLICATIONS

The entire disclosure of Japanese Patent Application No. 2018-198341 filed on Oct. 22, 2018, is incorporated herein by reference in its entirety.

BACKGROUND

Technological Field

The present invention relates to an image forming method.

Description of Related Art

In recent years, there have been increasing demands, in the on-demand printing market, for adding more value to printed matters by, for example, printing in a spot color, printing with a metallic tone or the like, and various methods have been examined for this purpose. As one of such methods, a method is known in which an image is decorated by causing a decoration to adhere to the image by utilizing an adhesive force imparted to the image.

For example, Japanese Patent Application Laid-Open No. H01-200985 discloses a method in which a toner image is formed, a foil having a colorant layer and an adhesive layer is overlaid on the toner image, and the resultant is heated and pressurized to decorate the toner image by utilizing welding of the toner by heating.

Besides, Japanese Patent Application Laid-Open No. 2013-178452 discloses a method in which an image of a heat-melting material is heated to impart adhesiveness thereto, and a paint powder is supplied to the thus obtained adhesive image to decorate the image.

SUMMARY

In an image forming method in which a resin layer disposed on a recording medium is softened to have adhesiveness, and a powder is supplied thereto to decorate a resin image, for example, if a flat powder is supplied onto the surface of the resin image in a state where the resin layer is not sufficiently softened, powder particles 200 supplied to resin layer 100 formed on recording medium S are horizontally aligned as illustrated in FIG. 1A. The merely horizontally aligned powder particles 200 have a limited decoration effect. For example, if particle particles 200 are metal particles, the decoration effect of the horizontally aligned state of the particles is limited to a mirror-like or pearl-like effect.

When the powder particles are to be aligned at an angle different from the horizontal direction, namely, aligned to be inclined against the surface of the recording medium, it is necessary to supply the powder onto the surface of the resin image with the resin layer sufficiently softened. As illustrated in FIG. 1B, when the powder is supplied with resin layer 100 sufficiently softened, powder particles 200 are aligned with some particles buried in sufficiently softened resin layer 100, and therefore, powder particles 200 can be aligned to be inclined against the surface of the recording medium. If powder particles 200 are metal particles, the decoration effect to be obtained in this state is a glittering effect.

In order to sufficiently soften the resin layer, however, it is necessary to heat the resin layer to a high temperature, or add a large amount of a softener to the resin layer. When the resin layer is heated to a high temperature or a large amount of a softener is added to the resin layer in this manner, there may occur a problem of large damage of the recording medium in some cases.

The present invention was devised in consideration of such circumstances, and an object is to provide an image forming method for forming a decorated image having a resin layer and a powder contacted with each other, by which an image having a glittering effect can be easily formed by supplying the powder without sufficiently softening the resin layer.

To achieve at least one of the abovementioned objects, according to an aspect of the present invention, an image forming method reflecting one aspect of the present invention is a method for forming a decorated image having a resin layer and a powder contacted with each other, the method comprising: forming a resin layer on a recording medium; and supplying a powder onto the recording medium, wherein the recording medium has a surface with an arithmetic mean height Sa of 1.000 or more.

To achieve at least one of the abovementioned objects, according to an aspect of the present invention, an image forming method reflecting one aspect of the present invention is a method for forming a decorated image, comprising: softening a resin layer included in a resin image including a recording medium having a surface with an arithmetic mean height Sa of 1.000 or more, and the resin layer formed on the recording medium; and supplying a powder onto a surface of the softened resin layer.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

According to an embodiment of the present invention, an image forming method for forming a decorated image having a resin layer and a powder contacted with each other, in which a powder particle can be placed in an inclined state without sufficiently softening the resin layer can be provided.

Embodiment 1

Embodiment 1 of the present invention relates to an image forming method for forming a decorated image having a resin layer and a powder contacted with each other, the method including a step of forming a resin layer on a recording medium, and a step of supplying a powder onto a surface of the resin layer. In the recording medium, a surface on which the resin layer is formed has an arithmetic mean height Sa of 1.000 or more. In the present embodiment, the image forming method may further include, after the step of supplying a powder onto a surface of the resin layer, a step of aligning the supplied powder. Besides, the image forming method may further include, after the step of aligning, a step of collecting a portion of the powder not adhering to the resin layer.

(Step of Forming Resin Layer)

Figure 1A:
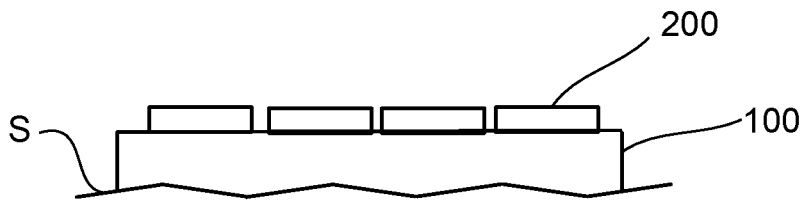
FIG. 1A is a schematic diagram illustrating a state where a decorated image is formed by supplying a powder onto a surface of a resin image without sufficiently softening a resin layer.
Figure 1B:
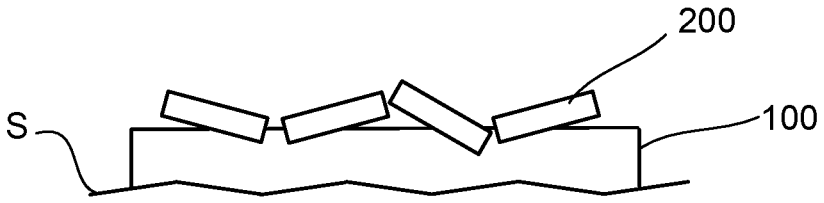
FIG. 1B is a schematic diagram illustrating a state where a decorated image is formed by supplying a powder onto a surface of a resin layer with the resin layer sufficiently softened.
Figure 2A:
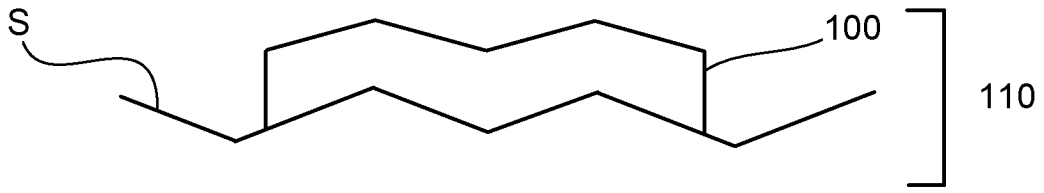
FIG. 2A is a schematic diagram illustrating a state where a resin layer is formed on a recording medium having a rough surface.

In this step, the resin layer is formed on the recording medium having a surface with an arithmetic average height Sa of 1.000 or more. FIG. 2A is a schematic diagram illustrating a state where a resin layer (toner image) is formed on recording medium S having Sa of 1.000 or more. As illustrated in FIG. 2A, when resin layer 100 is formed on the surface of recording medium S having Sa of 1.000 or more, the surface of resin layer 100 is also rough. It is noted that resin image 110 includes recording medium S and resin layer 100 formed on recording medium S.

The recording medium is not especially limited as long as the arithmetic average height Sa of the surface thereof is 1.000 or more. Examples of the recording medium include various kinds of media such as normal paper ranging from thin paper to cardboard, wood-free paper, coated print sheet such as art paper or coated paper, commercially available Japanese paper or postcard sheet, a plastic film, a resin film and a fabric. The recording medium having a surface with an arithmetic mean height Sa of 1.000 or more can be obtained by subjecting a recording medium having a surface with an average mean height Sa less than 1.000 (such as a resin film) to a roughening treatment by blasting or a plasma treatment. The recording medium is not especially limited in its color.

From the viewpoint of roughening the surface of the resin layer, the arithmetic mean height Sa of the surface of the recording medium is preferably 1.000 or more, more preferably 1.500 or more, further preferably 2.000 or more, and further more preferably 3.000 or more. The upper limit of Sa of the surface of the recording medium is not especially limited, and is preferably 5.000 or less from the viewpoint that the resin layer (toner image) can be easily formed by fixing a toner particle on the recording medium.

As the arithmetic mean height Sa, a value calculated based on a whole image region obtained, using a 50× objective lens, with a laser microscope VK-250 manufactured by Keyence Corporation is used.

The resin layer is not especially limited as long as it is a layer containing a resin.

Examples of the resin include various known resins such as a styrene-based resin, a (meth)acrylic-based resin, a styrene-(meth)acrylic-based copolymer resin, a vinyl-based resin such as an olefin-based resin, a polyester resin, a polyamide-based resin, a carbonate resin, polyether and a polyvinyl acetate-based resin.

The resin layer can be formed on the recording medium by any of known image forming methods such as a dry or wet electrophotographic method and an inkjet method.

In particular, the resin layer is preferably a layer including a toner image formed by the electrophotographic method, and preferably contains a toner particle fixed on the recording medium.

Besides, the resin layer preferably contains a plurality of types of toner particles fixed on the recording medium. When the resin layer contains a plurality of types of toner particles, a variety of decorated images can be formed by combining toner images and powders. The plurality of types of toner particles can be, for example, a plurality of types of toner particles different in color provided by a colorant contained therein, or a plurality of types of toner particles different in thermal characteristics. Examples of the toner particle include a black toner particle, a white toner particle, a clear toner particle, a cyan toner particle, a yellow toner particle and a magenta toner particle.

The arithmetic mean height Sa of the surface of the resin layer onto which the powder is supplied is preferably 0.700 or more. When the arithmetic mean height Sa of the surface of the resin layer is 0.700 or more, powder particles can be inclined in supplying the powder. When the powder contains, for example, a metal particle in this case, the resultant decorated image is provided with a glittering effect. From the viewpoint of inclining the powder particles, the arithmetic mean height Sa of the surface of the resin layer is preferably 1.000 or more, and more preferably 1.300 or more. The upper limit of the arithmetic mean height Sa of the surface of the resin layer is not especially limited, and is preferably 4.500 or less from the viewpoint of causing the powder to adhere to the resin layer.

A lower limit of an amount of toner to be adhered in forming the resin layer on the recording medium is preferably 0.5 $g/m^2$ or more from the viewpoint of causing the powder to adhere to the softened resin layer. An upper limit of the amount of toner to be adhered in forming the resin layer on the recording medium is preferably 15.0 $g/m^2$ or less, and more preferably less than 10.0 $g/m^2$ from the viewpoint that the resin layer is formed on the recording medium having the surface with the arithmetic mean height Sa of 1.000 or more, that the resin layer has given roughness, and that the powder particles are inclined in supplying the powder.

(Step of Supplying Powder)

Figure 2B:
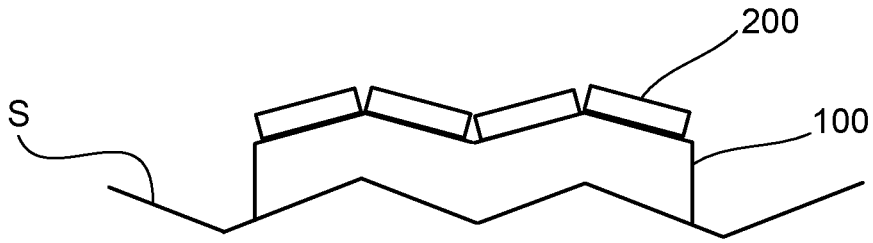
FIG. 2B is a schematic diagram illustrating a state where a decorated image is formed by supplying a powder in the state illustrated in FIG. 2A.

In this step, the powder is supplied onto the surface of the resin layer formed. FIG. 2B is a schematic diagram illustrating a state where the powder is supplied onto the surface of the resin layer in the state of FIG. 2A in which the resin layer is formed on recording medium S having the surface with the arithmetic mean height Sa of 1.000 or more. As illustrated in FIG. 2B, since the surface of the resin layer is also rough when the surface of recording medium S is rough, powder particles 200 can be inclined in supplying the powder. Here, when powder particle 200 is, for example, a metal particle, the decoration effect to be obtained is the glittering effect.

The powder is supplied onto the surface of the resin layer, and the decoration effect is exhibited in accordance with the resin layer and the powder. The powder is an aggregation of powder particles. For example, when a metallic decoration effect is desired to be obtained, the powder preferably contains a metal powder. Examples of the powder particle include a metal particle, a resin particle, a particle containing a thermoresponsive material, a magnetic particle and a non-magnetic particle. Besides, the powder particle may contain two or more different materials. The powder particle may be in the shape of a spherical particle or a non-spherical particle. The powder may be a synthetic product or a commercially available product. The powder may be a mixture of two or more different powder particles. It is noted that the powder is not a toner.

The powder particle may be coated. For example, a metal particle may be coated with a different metal, a metal oxide or a resin, or the surface of a resin, glass or the like may be coated with a metal or a metal oxide. Besides, a metal particle may be a metal oxide particle, or may be a metal oxide particle coated with a different metal oxide, a metal or a resin. Alternatively, the metal particle may be a particle obtained by extending a metal or a metal oxide into a plate shape and pulverizing the resultant, or such a particle coated with any of various materials, or a film or glass on which a metal or a metal oxide is deposited or wet coated. In order to obtain a metallic image, the metal particle preferably contains a metal or a metal oxide, and a content of the metal or the metal oxide is preferably 0.2 wt % to 100 wt %.

The non-spherical particle is a particle different from a spherical particle. A spherical particle is a particle whose projection shape has average circularity of 0.970 or more with regard to each of 100 powder particles randomly selected. It is noted that the average circularity can be obtained by a known method, or may be a catalog value.

From the viewpoint of inclining the powder particle along the surface of the resin layer, the non-spherical particle is preferably a flat particle having a flat particle shape. The term "flat particle shape" of the non-spherical particle means a shape having a ratio of a short diameter to a thickness (short diameter/thickness) of 5 or more, assuming that a maximum length of the non-spherical particle corresponds to a long diameter, that a maximum length in a perpendicular direction to the long diameter corresponds to the short diameter, and that a minimum length in a direction perpendicular to both the long diameter and the short diameter corresponds to a thickness.

The long diameter, the short diameter and the thickness of the powder particle are measured using a scanning electron microscope as follows. A powder particle is caused to adhere to a carbon tape to have a large contact area, and the resultant is used as a measurement sample. The long diameter and the short diameter are measured by observing the powder particle with the scanning electron microscope from directly above the surface of the carbon tape. On the other hand, the thickness is measured by observing the powder particle with the scanning electron microscope from a lateral direction to the surface of the carbon tape.

From the viewpoint of inclining the powder particle, the flat particle shape has a long diameter of preferably 10 μm or more and 100 μm or less, and a short diameter of preferably 10 μm or more and 100 μm or less.

The flat particle shape has a thickness of preferably 0.2 μm or more and 3.0 μm or less. When the thickness of the flat particle shape is 0.2 μm or more, the powder aligned along the surface of the resin layer can easily provide a desired appearance. When the thickness of the flat particle shape is 3.0 μm or less, the powder is difficult to peel off when the resultant image is rubbed.

Examples of the non-spherical particle include Sunshine Babe, Chrome Powder, Aurora Powder and Pearl Powder (all manufactured by GG Corporation Inc.), ICEGEL Mirror Metal Powder (manufactured by TAT Inc.), Pica Ace MC Shine Dust and Effect C (manufactured by Kabushiki Kaisha Kurachi, "Pica Ace" being their registered trademark), PREGEL Magic Powder, Mirror Series (manufactured by Yugen Kaisha Preanfa, "PREGEL" being their registered trademark), BONNAIL Shine Powder (manufactured by K's Planning Co., Ltd., "BONNAIL" being their registered trademark), MetaShine (manufactured by Nippon Sheet Glass Co., Ltd., their registered trademark), ELgee neo (manufactured by Oike & Co., Ltd., their registered trademark), Astroflake (manufactured by Nihonboshitsu Co., Ltd., registered trademark of Hajime Okazaki), and Aluminum Pigment (manufactured by Toyo Aluminum K.K.).

The thermoresponsive material is a material that is changed, by thermal stimulation, in shape such as expansion, shrinkage or deformation, or in color such as color development, decolorization or discoloration. Examples of the particle containing a thermoresponsive material include a thermally expandable microcapsule and a temperature-sensitive capsule. Examples of the thermally expandable microcapsule include Matsumoto Microsphere (manufactured by Matsumoto Yushi-Seiyaku Co., Ltd.) and Kureha Microsphere (manufactured by Kureha Corporation), and an example of the temperature-sensitive capsule includes a temperature-sensitive dye capsule (manufactured by Japan Capsular Products Inc.).

The powder can be supplied by a known means, and for example, a powder supplying means described in PTL 2 can be used.

In the present embodiment, the supplied powder is caused to adhere to the softened resin layer. Thus, a decorated image can be formed having the resin layer and the powder contacted with each other.

The softening can be performed by heating the resin layer, or can be performed by adding a softener capable of softening the resin layer to the surface of the resin layer.

The heating is not especially limited as long as the resin layer can be softened. The heating is performed such that the temperature of the recording medium can be lower than a temperature at which the recording medium is deformed, or such that the temperature of the powder can be lower than a temperature at which the powder is degraded, changed in color or deformed. When a toner is used in the resin layer, the heating is preferably performed at about 80° C. to 170° C. The heating may be performed after the supply of the powder, before the supply of the powder, or simultaneously with the supply of the powder. The heating is performed by heating the recording medium from a side of the rear surface thereof using, for example, a hot plate.

The softener is not especially limited as long as it can soften the resin layer. Examples of the softener include an organic solvent, alcohols, ketones, esters, ethers and a solution containing any of these, and specific examples include isobutyl adipate, tetrahydrofuran and a solution containing any of these. When the softener is added to the surface of the resin layer, the resin contained in the resin layer is partially dissolved or swollen, which is probably the reason why the resin layer is softened.

The addition of the softener is not especially limited as long as the softener can be added to the surface of the resin layer. Examples of a method for adding the softener include spray coating, an inkjet method and a coating method using a dispenser. The softener may be added before the supply of the powder, after the supply of the powder or simultaneously with the supply of the powder. An amount of the softener to be added is not especially limited, and may be arbitrarily adjusted in accordance with the resin layer, the powder, a desired decoration effect and the like, and the softener may be added to an extent where the resin layer is sufficiently softened, or to an extent where the resin layer starts to have adhesive ability.

The softener may be adjusted to have a desired film thickness before the supply. The film thickness of the supplied softener is, for example, preferably 0.1 μm to 10 μm, more preferably 0.5 μm to 5 μm, and further preferably 1 μm to 3 μm.

(Step of Aligning Powder)

In this step, the powder supplied onto the surface of the resin layer is aligned.

The alignment is a step of aligning the direction of the supplied powder in accordance with the surface of the resin layer, and the step is not especially limited as long as the direction of the powder can be aligned in accordance with the surface of the resin layer at least to some extent. The alignment can be performed, for example, by rubbing, by blowing toward the surface of the resin layer onto which the powder has been supplied, or if the powder contains a magnetic particle, by attracting the powder from the rear surface of the recording medium with a magnetic force.

The rubbing means that a rubbing member in contact with the surface of the resin layer onto which the powder has been supplied is moved relatively to the surface. From the viewpoint of aligning the powder on the surface of the resin layer, and from the viewpoint of enhancing adhesion of the powder to the resin layer, the rubbing is performed preferably under pressing. The term "pressing" means pressing the surface of the resin layer in a direction crossing the surface of the resin layer (for example, in the vertical direction). The pressing is performed with a force within a range for allowing elastic recovery of the resin layer, and hence the arithmetic mean height Sa of the surface of the resin layer can be retained through the rubbing.

In the rubbing, when a rubbing speed is too low, the powder may be insufficiently aligned in accordance with the surface of the resin layer, and when the rubbing speed is too high, the adhesion of the powder may be so insufficient that the alignment of the powder in accordance with the surface of the resin layer may be insufficient, and hence, desired appearance clarity of a final image may be degraded in some cases. From the viewpoint of attaining sufficient adhesion and alignment of the powder on the surface of the resin layer, a relative speed difference of the rubbing member relative to the surface of the resin layer is preferably 5 mm/sec to 500 mm/sec, and more preferably 70 mm/sec to 130 mm/sec.

In the rubbing, when a contact width of the rubbing member against the surface of the resin layer is too small, the direction of the powder is easily varied in moving the rubbing member along the surface of the resin layer, and hence the alignment of the powder adhering to the resin layer may be insufficient in some cases, and when the contact width is too large, the recording medium is difficult to convey. From the viewpoint of sufficiently realizing a desired aligning property of the powder adhering to the surface of the resin layer and a conveying property of the recording medium, the contact width is preferably 1 mm to 200 mm in terms of a length in the moving direction of the rubbing member against the resin layer.

In the rubbing, when a pressing force is too small, the adhesion strength of the powder may be weakened in some cases, and when the pressing force is too large, the resin layer itself may be disturbed, and a torque in conveying the resin image may be increased in some cases. From the viewpoint of smoothly conveying the resin image with labor saved, from the viewpoint of retaining the image formed on the resin layer, and from the viewpoint of increasing the adhesion strength of the powder, the pressing force is preferably 1 to 30 kPa, and more preferably 7 to 13 kPa against the surface of the resin layer.

The rubbing member may be configured to be movable in a direction relatively different from the resin layer while pressing the surface of the resin layer.

The rubbing member may be a rotating member, or may be a non-rotating member such as a reciprocating member or a fixed member. The rubbing member may be a member that is in contact with the substantially horizontal surface of the resin layer and is movable relatively to the surface in a horizontal direction, a member that is in contact with the substantially horizontal surface of the resin layer and is relatively rotatable around a rotation axis along a direction vertical to the surface, or a rotatable roller in contact with the surface of the resin layer.

The rubbing member is configured to have its surface movable relatively to the surface of the resin layer while pressing the resin layer. The rubbing by the rubbing member can be performed, for example, by rubbing with a fixed rubbing member during conveyance of the recording medium having the resin layer formed thereon, by rubbing with a roller rotated at a speed lower than a conveyance speed during the conveyance, by rubbing with a roller rotated in a direction reverse to the conveyance direction during the conveyance, by rubbing with a rotatable roller disposed to have its rotation axis inclined against the conveyance direction, by rubbing with a member reciprocating on the surface of the recording medium having the resin layer formed thereon, or by rubbing with a member rotating around a rotation axis along the direction vertical to the surface of the recording medium having the resin layer formed thereon.

The rubbing member is preferably flexible. The flexibility of the rubbing member is, for example, softness (property to follow deformation) to an extent where the surface of the rubbing member is deformed to be able to follow the shape of the surface of the resin layer when pressed. Examples of the rubbing member having such flexibility include a sponge and a brush.

(Step of Collecting Powder)

In this step, a portion of the powder not adhering to the resin layer is collected. The collection is performed, for example, using a dust collector for sucking an excessive portion of the powder. The dust collector is disposed to have a suction port thereof opened at an appropriate height from a conveyance path of the recording medium, and is configured to be operated at an appropriate output level, for example, for sucking a powder but not sucking the recording medium.

According to the present embodiment, since the recording medium having the surface with an arithmetic mean height Sa of 1.000 or more is used, the powder particle can be inclined, and hence there is no need to incline the powder particle by placing the resin layer in a softened state. Therefore, this image forming method can be applied to a recording medium and a resin layer that can be easily damaged, for example, at a high temperature or when a large amount of a softener is supplied, and thus, an image decorated with the inclined powder can be obtained.

According to another embodiment of the present invention, in a resin image including a resin layer formed on a recording medium having a surface with an arithmetic mean height Sa of 1.000 or more, a decorated image may be formed by softening the resin layer and supplying a powder onto the surface of the softened resin layer.

Embodiment 2

Embodiment 2 of the present invention relates to an image forming method for forming a decorated image having a resin layer and a powder contacted with each other, the method including a step of adding a powder onto a recording medium, and a step of forming a resin layer on the recording medium to which the powder has been added.

The recording medium has a surface with an arithmetic mean height Sa of 1.000 or more. In the present embodiment, the step of forming a resin layer is performed after the step of supplying a powder. The present embodiment may further include a step of collecting a portion of the powder not adhering to the resin layer.

The powder can be supplied by a known means, and for example, the powder supplying means described in PTL 2 can be used.

Figure 3A:
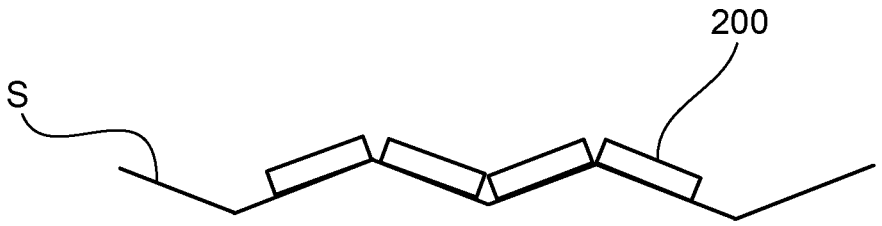
FIG. 3A is a schematic diagram illustrating a state where a powder is supplied onto a recording medium having a rough surface.

FIG. 3A is a schematic diagram illustrating a state where a powder is supplied onto recording medium S having a surface with an arithmetic mean height Sa of 1.000 or more. As illustrated in FIG. 3A, when a powder is supplied onto recording medium S having a surface with Sa of 1.000 or more, powder particle 200 is in an inclined state.

The powder is supplied onto the recording medium and a decoration effect is exhibited in accordance with the resin layer and the powder. The powder is an aggregation of powder particles. For example, when a metallic decoration effect is desired to be obtained, the powder preferably contains a metal powder. Examples of the powder particle include a metal particle, a resin particle, a magnetic particle and a non-magnetic particle. The powder particle may be similar to the powder particle used in Embodiment 1. The shape and the like of the powder particle may be similar to those of the powder particle used in Embodiment 1.

The step of forming a resin layer is performed after the step of supplying a powder.

Figure 3B:
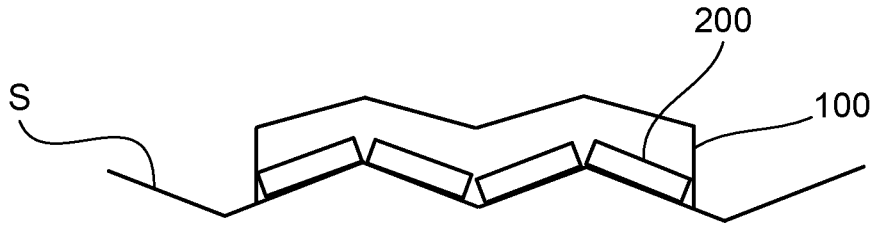
FIG. 3B is a schematic diagram illustrating a state where a decorated image is formed by forming a resin layer in the state illustrated in FIG. 3A.

FIG. 3B is a schematic diagram illustrating a state where a decorated image is formed by forming a resin layer in the state of FIG. 3A. As illustrated in FIG. 3B, powder particle 200 in the inclined state can be fixed by forming the resin layer.

The resin layer may be formed in the same manner as in Embodiment 1, and can be formed on the recording medium by a known image forming method such as the wet or dry electrophotographic method or the inkjet method. In particular, the resin layer is preferably a layer including a toner image formed by the electrophotographic method, and preferably contains a toner particle. The toner particle may be similar to the toner particle described in Embodiment 1, and from the viewpoint of further exhibiting the decoration effect owing to the powder, the toner particle preferably has high optical transparency. When a metallic image retaining a color tone of the powder is desired to be obtained, a clear toner is preferably selected, and when a metallic image with a color tone of the powder adjusted is desired to be obtained, a color toner with a desired color tone is preferably selected from a cyan toner, a magenta toner, a yellow toner and the like. Besides, a mixture of a plurality of types of toners can be used.

An amount of a toner to be adhered in supplying the resin layer on the powder is preferably 0.5 g/m$^2$ or more from the viewpoint of fixing the powder, and is preferably 15.0 g/m$^2$ or less, and more preferably less than 10.0 g/m$^2$ from the viewpoint of inhibiting light scattering and light absorption by the toner to obtain a metallically decorated image.

A portion of the powder not adhering to the resin layer may be collected in the same manner as in Embodiment 1, and for example, a dust collector for sucking an excessive portion of the powder is used. The dust collector is disposed to have a suction port thereof opened at an appropriate height from a conveyance path of the recording medium, and is configured to be operated at an appropriate output level, for example, for sucking a portion of the powder not adhering but not sucking the recording medium.

Embodiment 3

Embodiment 3 of the present invention relates to an image forming apparatus to be used in, for example, the image forming method according to Embodiment 1. The image forming apparatus will be described with reference to FIGS. 4 and 5.

Figure 4:
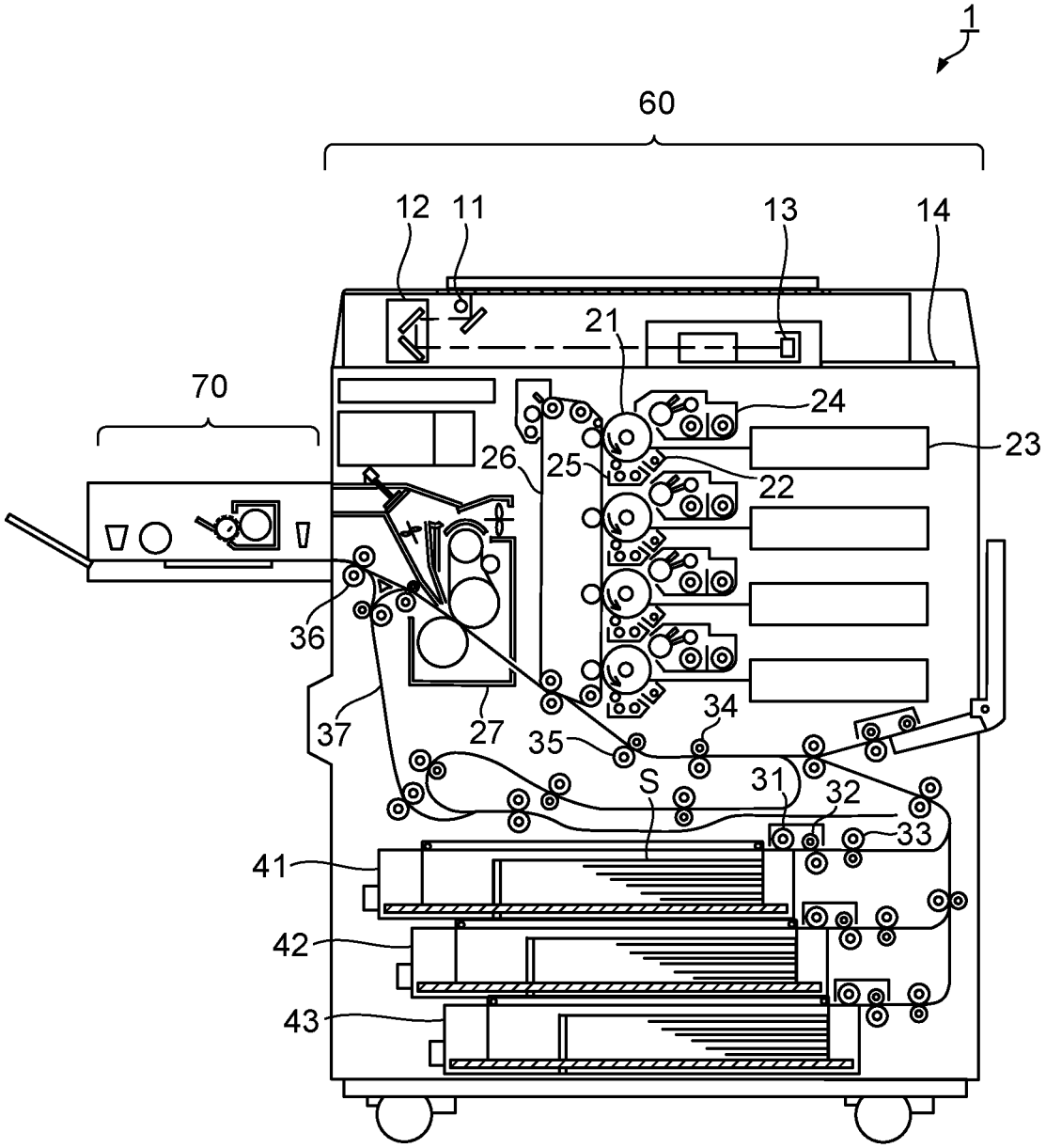
FIG. 4 is a schematic diagram of a structure of an image forming apparatus according to one embodiment of the present invention.

Image forming apparatus 1 according to Embodiment 3 includes, as illustrated in FIG. 4, resin image forming section 60 and surface treating section 70. Resin image forming section 60 is a part for forming a recording medium having a surface with an arithmetic mean height Sa of 1.000 or more and a resin layer fixed thereon. Surface treating section 70 is a part for treating a surface of the resin layer formed by resin image forming section 60 for decoration.

Resin image forming section 60 has a structure similar to that of a known color printer. Resin image forming section 60 includes an image reading section, an image forming section, a sheet conveying section, a sheet feeding section, a data receiving section, a control section and fixing section 27.

The image reading section includes light source 11, optical system 12, imaging device 13 and image processing section 14.

The image forming section includes an image forming section for forming an image of a yellow (Y) toner, an image forming section for forming an image of a magenta (M) toner, an image forming section for forming an image of a cyan (C) toner, an image forming section for forming an image of a black (K) toner, and intermediate transfer belt 26. It is noted that Y, M, C and K corresponds to the colors of toners.

The image forming section includes a rotating member of photoconductor drum 21, and charging section 22, optical writing section 23, developing device 24 and drum cleaner 25 disposed around the photoconductor drum. Intermediate transfer belt 26 is wound around a plurality of rollers to be movably supported.

The sheet conveying section includes feed roller 31, separation roller 32, conveyance roller 33, loop roller 34, registration roller 35, sheet ejection roller 36 and sheet inverting section 37. The sheet feeding section includes a plurality of sheet feed trays 41, 42 and 43 each holding recording media S therein.

The control section includes a CPU (Central Processing Unit), a RAM (Random Access Memory) and a ROM (Read Only Memory). The CPU controls, in accordance with programs stored in the ROM, the image reading section, the image forming section, the sheet conveying section, the sheet feeding section and surface treating section 70, and stores operation results and the like in the RAM. Besides, the control section performs control to analyze print data externally received to generate image data in a bit map format, and to form an image based on the image data on recording medium S. The programs include a program for adjusting a softened state of the resin layer and a program for setting rubbing conditions in surface treating section 70.

Besides, the control section transmits/receives, through a communication section not shown, various data to/from an external apparatus (such as a personal computer) connected to a communication network such as a LAN (Local Area Network) or WAN (Wide Area Network). The control section receives, for example, image data transmitted from an external apparatus, or input data on a decorated image to be formed received by the data receiving section, and allows an image to be formed on recording medium S based on this image data (input image data). The communication section is constituted by a communication control card such as a LAN card.

The resin layer formed by resin image forming section 60 is conveyed to surface treating section 70 to be decorated.

Figure 5:
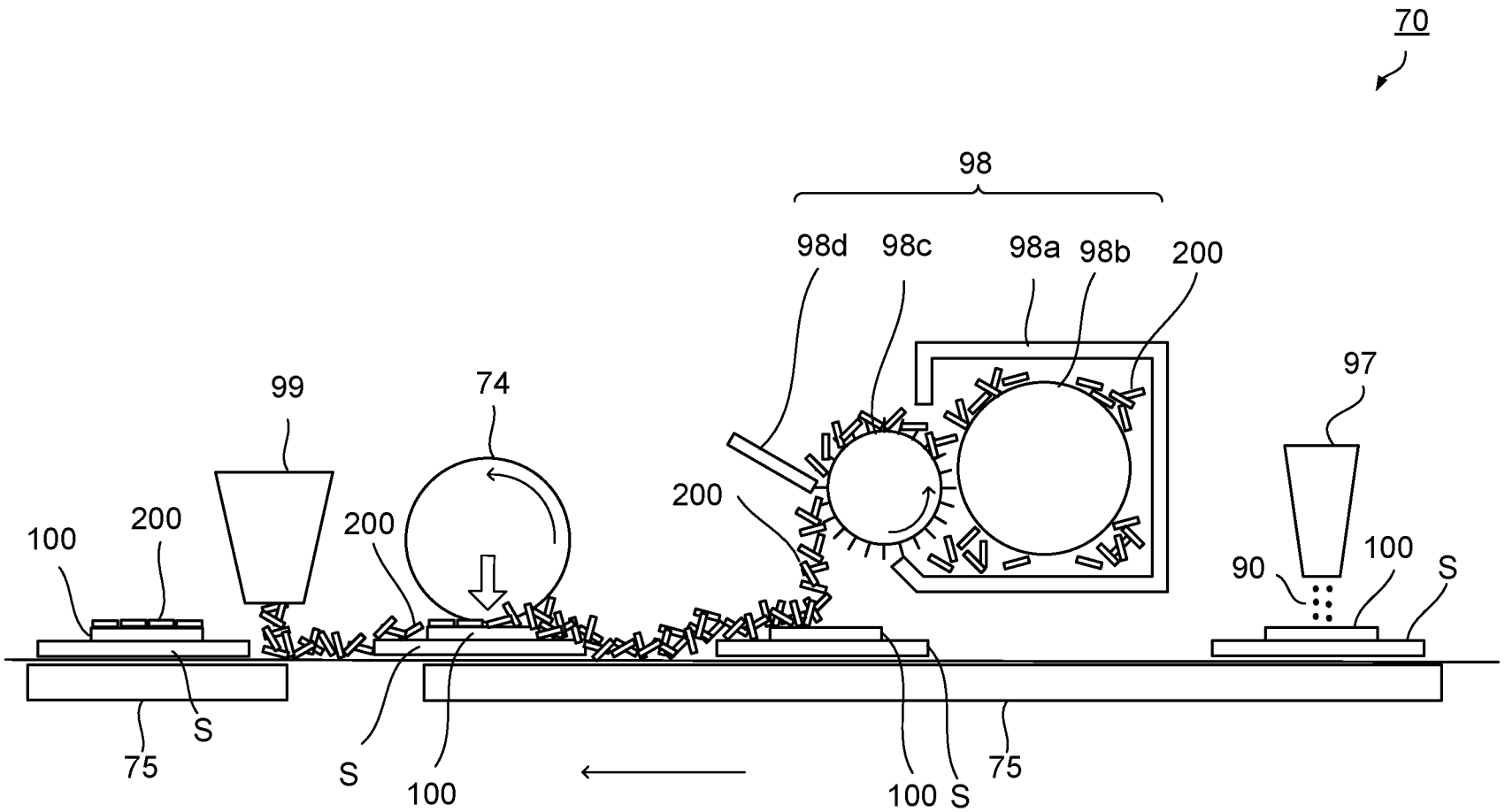
FIG. 5 is a schematic diagram of a structure of a surface treating section of the image forming apparatus according to the embodiment of the present invention.

As illustrated in FIG. 5, surface treating section 70 includes heater 75 and softener supply section 97 as means for softening the resin layer. It includes powder supply section 98 as a powder supplying means, rubbing roller 74 and powder collecting section 99.

Heater 75 heats recording medium S from a side of the rear surface thereof to soften resin layer 100 fixed on recording medium S. Heater 75 is not especially limited as long as resin layer 100 can be heated. An example of heater 75 includes a hot plate.

Softener supply section 97 supplies softener 90 to the surface of resin layer 100 fixed on recording medium S. The softener supply section is not especially limited as long as the softener can be added. Examples of the softener supply section include a spray, an inkjet and a dispenser.

In order to soften the resin layer, either one of or both of heater 75 and softener supply section 97 may be used. Besides, the image forming apparatus may include any one of heater 75 and softener supply section 97.

Powder supply section 98 supplies a powder to resin layer 100. The powder supplying means may be any known means, and for example, the powder supplying means described in PTL 2 can be used.

Powder supply section 98 includes vessel 98*a* for holding powder particle 200 therein, conveyance screw 98*b* for conveying powder particle 200 to an opening of vessel 98*a*, brush roller 98*c* for taking powder particle 200 out of vessel 98*a* and flicker 98*d* for flicking off powder particle 200 held on brush roller 98*c*. Powder particle 200 is a non-spherical powder particle having, for example, the flat particle shape described above.

The opening of vessel 98*a* is formed in a size coming into contact with a tip of a brush of brush roller 98*c* to restrict the amount of powder particles 200 held on brush roller 98*c*. Flicker 98*d* is a plate-shaped member, and is disposed in a position in contact with brush roller 98*c*. Intrusion of brush roller 98*c* into flicker 98*d* can be determined in consideration of, for example, the amount of powder particle 200 to be supplied and uneven wear of the brush, and the length and the density of brush hairs of brush roller 98*c* can be determined in consideration of, for example, the amount of powder particle 200 to be supplied and burping of powder particle 200.

Flicker 98*d* may be fixed in a position in contact with brush roller 98*c*, or flicker 98*d* may be constructed to be movable so that flicker 98*d* can be moved away from brush roller 98*c* during a stop of brush roller 98*c*.

Rubbing roller 74 corresponding to a rubbing member has a rotation axis vertical to the conveyance direction of recording medium S and vertical to the sheet surface, and is constructed to be rotatable in a direction indicated by an arrow in the drawing, and constructed to be biased by a biasing member (not shown). Rubbing roller 74 includes, for example, a cylindrical core metal, and an elastic layer disposed on the outer peripheral surface of the core metal and made of a resin sponge or the like. The axial length of rubbing roller 74 is preferably longer than the width of recording medium S.

Although the rubbing member is illustrated as rubbing roller 74 in FIG. 5, the rubbing member is not especially limited as long as it can perform the rubbing, and may be a reciprocating member, a member rotating around a rotation axis along the direction vertical to the surface of the resin image, or a fixed member.

Heater 75 may be provided, as illustrated in FIG. 5, to extend from a position in front of softener supply section 97 to a position opposing rubbing roller 74. Alternatively, heater 75 may be provided in a position in front of softener supply section 97, a position opposing softener supply section 97, a position opposing powder supply section 98, a position opposing rubbing roller 74, or a position after rubbing roller 74. Heater 75 is, for example, a hot plate. Heater 75 may be used for various purposes of softening the resin layer by heating, increasing a process speed, heating a thermoresponsive material supplied onto the surface of the resin layer, and the like in a temperature range where the recording medium or the powder is not thermally deformed.

Powder collecting section 99 is, for example, a dust collector for sucking an excessive portion of powder particles 200 out of all powder particles 200 supplied from powder supply section 98. The dust collector is disposed to have a suction port thereof opened at an appropriate height from a conveyance path of recording medium S, and is configured to be operated at an appropriate output level, for example, for sucking powder particles 200 but not sucking recording medium S.

Next, one embodiment regarding how the resin layer is formed and how the formed resin image is decorated will be described with reference to FIGS. 4 and 5. In image forming apparatus 1 of FIG. 4, the control section controls the operations of the image reading section, the image forming section, the sheet conveying section, the sheet feeding section and surface treating section 70.

In the image reading section, light emitted from light source 11 is applied to an original placed on a reading surface, and reflected light passes through a lens and a reflecting mirror of optical system 12 to be imaged on imaging device 13 having moved to a reading position Imaging device 13 generates an electric signal in accordance with the intensity of the reflected light from the original. The thus generated electric signal of an analog signal is converted into a digital signal in image processing section 14, then subjected to correction processing, filter processing, image compression processing and the like, and stored in a memory of image processing section 14 as image data. In this manner, the image reading section reads an image of an original to store image data.

In the image forming section, photoconductor drum 21 is rotated at a prescribed speed by a drum motor. Charging section 22 charges the surface of photoconductor drum 21 to a desired potential, and optical writing section 23 writes, based on the image data, an image information signal on photoconductor drum 21, and forms a latent image based on the image information signal on photoconductor drum 21. Then, the latent image is developed by developing device 24, and a toner image, that is, a visible image, is formed on photoconductor drum 21. In this manner, unfixed toner images of yellow, magenta, cyan and black colors are respectively formed on photoconductor drums 21 of the Y, M, C and K image forming sections. Thus, the image forming section forms the toner image by employing electrophotographic image forming process.

The toner images of the respective colors formed by the Y, M, C and K image forming sections are successively transferred by a primary transferring section onto intermediate transfer belt 26 moving. In this manner, a color toner image including toner layers of yellow, magenta, cyan and black colors superimposed on one another is formed on intermediate transfer belt 26.

In the sheet conveying section, recording medium S is fed to the conveyance path one by one from sheet feed tray 41, 42 or 43 of the sheet feeding section by feed roller 31 and separation roller 32. Recording medium S fed to the conveyance path is conveyed through the conveyance path by conveyance roller 33 through loop roller 34 and registration roller 35 to a secondary transfer roller. Then, the color toner image on intermediate transfer belt 26 is transferred onto recording medium S.

To recording medium S onto which the color toner image has been transferred, heat and pressure are applied by fixing section 27, and thus, the color toner image on recording medium S is fixed on recording medium S as a color toner layer. In this manner, resin layer 100 is formed on recording medium S. Recording medium S including resin layer 100 is fed through sheet ejection roller 36 to surface treating section 70.

Recording medium S on which the resin layer has been fixed can be introduced to sheet inverting section 37 to turn over recording medium S before ejection. In this manner, images can be formed on the both surfaces of recording medium S.

Resin layer 100 is adjusted to be in a desired softened state by supplying the softener by softener supply section 97 or by heating by heater 75, and an adhesive force is caused in the surface of resin layer 100.

In powder supply section 98, powder particles 200 held in vessel 98*a* are conveyed by conveyance screw 98*b* to brush roller 98*c*. Brush roller 98*c* rotates, for example, counterclockwise, and captures powder particles 200. Powder particles 200 captured by brush roller 98*c* are flicked by flicker 98*d* to be scattered on recording medium S and resin layer 100.

Rubbing roller 74 is biased toward recording medium S and is rotating in the direction indicated by the arrow in the drawing. Rubbing roller 74 is rotating in a direction opposite to the conveyance direction of recording medium S. Rubbing roller 74 rotates while pressing powder particles 200 on resin layer 100 with an appropriate pressing force (of, for example, about 10 kPa), and therefore, the surface of rubbing roller 74 rubs the surface of resin layer 100 onto which powder particles 200 have been supplied. Since the surface of resin layer 100 has adhesiveness, is supplied with powder particles 200 and is rubbed by rubbing roller 74, powder particles 200 adhere to the surface of resin layer 100 to be aligned along the surface.

More specifically, powder particles 200 may not be aligned when simply supplied onto the surface of resin layer 100. Powder particles 200 on resin layer 100 are, however, rubbed while appropriately pressed by rubbing roller 74. Therefore, powder particles 200 are inclined and adhere along the surface of resin layer 100 as illustrated in FIG. 2B. A final image thus obtained attains a glittering appearance.

Among powder particles 200 scattered on recording medium S, an excessive portion of powder particles 200 present on a part where no resin layer is formed is sucked by powder collecting section 99 through air flow caused by powder collecting section 99, and removed from recording medium S, resin image 110 and the conveyance path.

The surface of recording medium S on which resin layer 100 has been formed is not wholly covered by powder particles 200. A covering ratio of the surface by powder particles 200 is, for example, about 60%.

Accordingly, in a final image, an appearance resulting from a combination of a visual effect owing to the layer of powder particles 200 and a visual effect of the image (underlying image) formed by recording medium S and the resin layer (toner layer) can be obtained.

Although the image forming apparatus is combined with an electrophotographic color printer in the embodiment illustrated in the drawings, the image forming apparatus may be separately constructed. Alternatively, the image forming apparatus may be incorporated into the color printer to be integrated with the color printer.

Embodiment 4

Embodiment 4 of the present invention is an image forming apparatus used in, for example, the image forming method according to Embodiment 2. This image forming apparatus includes a device for supplying a powder before a resin image forming section.

EXAMPLES

Now, specific Examples of the embodiments will be described together with Comparative Examples. It is noted that the technical scope of the present invention is not limited to the following Examples alone.

1. Preparation of Developer 1-1. Preparation of Colorant Dispersion A resin image of the present embodiment was formed by outputting a toner (resin layer) onto a recording medium using a remodeled machine of "AccurioPress C2060" (manufactured by Konica Minolta, Inc., "AccurioPress" being their registered trademark) loaded with a developer. As a colorant dispersion to be used for preparing the developer, a dispersion for black color and a dispersion for cyan color were prepared as follows.

[Preparation of Dispersion for Black Color]

A surfactant aqueous solution was prepared by adding 11.5 parts by mass of sodium n-dodecyl sulfate to 160 parts by mass of ion-exchanged water, and dissolving and stirring the resultant. To the surfactant aqueous solution, 15 parts by mass of carbon black (Mogul L, manufactured by Cabot Corporation) was gradually added, and a dispersion treatment was performed using "Clearmix W Motion CLM-0.8" (manufactured by M Technique Co., Ltd., "Clearmix" being their registered trademark). In this manner, a solution in which fine particles of the black colorant were dispersed (dispersion for black color) was prepared.

The particle size of the fine particles of the black colorant in the dispersion for black color was 220 nm in terms of a volume-based median diameter. The volume-based median diameter was obtained by measurement performed using "MICROTRAC UPA-150" (manufactured by HONEYWELL) under the following measurement conditions:

Refractive index of sample: 1.59

Specific gravity of sample: 1.05 (in terms of spherical particle)

Refractive index of solvent: 1.33

Viscosity of solvent: 0.797 (30° C.), 1.002 (20° C.)

Zero-point adjustment: adjusted by putting ion-exchanged water into measurement cell

[Preparation of Dispersion for Cyan Color]

A dispersion in which fine particles of a cyan colorant (dispersion for cyan color) was prepared in the same manner as in the preparation of the dispersion for black color except that "C.I. Pigment Blue 15:3" was used instead of "carbon black: Mogul L." A median diameter of the fine particles of the cyan colorant in the dispersion for cyan color was 110 nm.

1-2. Preparation of Core Resin Particle

A core resin particle of a toner particle used in the preparation of the developer was prepared through first stage polymerization, second stage polymerization and third stage polymerization described below.

(a) First Stage Polymerization

In a reaction vessel equipped with a stirrer, a temperature sensor, a condenser and a nitrogen-introducing device, surfactant aqueous solution 1 obtained by dissolving 4 parts by mass of sodium polyoxyethylene-2-dodecyl ether sulfate in 3,040 parts by mass of ion-exchanged water was placed, and the temperature of the solution was increased to 80° C. under nitrogen stream with stirring at a stirring speed of 230 rpm.

To surfactant aqueous solution 1, polymerization initiator solution 1 obtained by dissolving 10 parts by mass of potassium persulfate in 400 parts by mass of ion-exchanged water was added, the temperature of the resultant mixture was increased to 75° C., and monomer mixture 1 containing the following components in the following amounts was then added in a dropwise manner to the mixture over 1 hour.

styrene: 532 parts by mass n-butyl acrylate: 200 parts by mass methacrylic acid: 68 parts by mass n-octyl mercaptan: 16.4 parts by mass After the dropwise addition of monomer mixture 1, polymerization (first stage polymerization) was performed by heating and stirring the resultant reaction solution at 75° C. over 2 hours, and thus, resin particle A1 was prepared.

(b) Second Stage Polymerization

In a flask equipped with a stirrer, monomer mixture 2 containing the following components in the following amounts was placed, and 93.8 parts by mass of paraffin wax "HNP-57" (manufactured by Nippon Seiro Co., Ltd.) used as a release agent was added thereto and dissolved therein by heating to 90° C.

styrene: 101.1 parts by mass n-butyl acrylate: 62.2 parts by mass methacrylic acid: 12.3 parts by mass n-octyl mercaptan: 1.75 parts by mass On the other hand, surfactant aqueous solution 2 obtained by dissolving 3 parts by mass of sodium polyoxyethylene-2-dodecyl ether sulfate in 1,560 parts by mass of ion-exchanged water was prepared and heated to 98° C. To surfactant aqueous solution 2, 32.8 parts by mass of resin particle A1 was added, and monomer mixture 2 was further added thereto, and then, the resultant was dispersed by mixing for 8 hours using a mechanical dispersion apparatus "Clearmix" (manufactured by M Technique Co., Ltd.) having a circulation path. Through this dispersion by mixing, emulsified particle dispersion 1 containing an emulsified particle having a dispersed particle size of 340 nm was prepared.

Subsequently, to emulsified particle dispersion 1, polymerization initiator solution 2 obtained by dissolving 6 parts by mass of potassium persulfate in 200 parts by mass of ion-exchanged water was added, and polymerization (second stage polymerization) was performed by heating and stirring the resultant mixture at 98° C. over 12 hours, and thus, resin particle A2 was prepared, and a dispersion containing resin particle A2 was obtained.

(c) Third Stage Polymerization

To the dispersion containing resin particle A2, polymerization initiator solution 3 obtained by dissolving 5.45 parts by mass of potassium persulfate in 220 parts by mass of ion-exchanged water was added, and to the resultant dispersion, monomer mixture 3 containing the following components in the following amounts was added in a dropwise manner at 80° C. over 1 hour.

styrene: 293.8 parts by mass n-butyl acrylate: 154.1 parts by mass n-octyl mercaptan: 7.08 parts by mass After completing the dropwise addition, polymerization (third stage polymerization) was performed by heating and stirring the resultant over 2 hours, and after completing the polymerization, the resultant was cooled to 28° C., and thus a core resin particle was prepared.

1-3. Preparation of Shell Resin Particle

A shell resin particle of the toner particle used in the preparation of the developer was prepared as follows.

A shell resin particle was prepared trough one stage polymerization reaction and a post-reaction treatment in the same manner as described above except that monomer mixture 1 used in the first stage polymerization of the preparation of the core resin particle was changed to monomer mixture 4 containing the following components in the following amounts.

styrene: 624 parts by mass 2-ethylhexyl acrylate: 120 parts by mass methacrylic acid: 56 parts by mass n-octyl mercaptan: 16.4 parts by mass 1-4. Preparation of Toner Particle

[Preparation of Black Toner Particle]

A core of the toner particle was prepared using the core resin particle and the dispersion for black color, then, a shell was formed on the core by using the shell resin particle to prepare a toner mother particle, and an external additive addition step was ultimately performed to prepare a black toner particle as follows.

(a) Preparation of Core

In a reaction vessel equipped with a stirrer, a temperature sensor, a condenser and a nitrogen-introducing device, the following components were placed in the following amounts, and the resultant was stirred. The temperature of the thus obtained mixture was adjusted to 30° C., and a 5 mol/liter sodium hydroxide aqueous solution was then added to the mixture to adjust pH to 8 to 11.

core resin particle: 420.7 parts by mass ion-exchanged water: 900 parts by mass dispersion for black color: 300 parts by mass Subsequently, an aqueous solution obtained by dissolving 2 parts by mass of magnesium chloride hexahydrate in 1,000 parts by mass of ion-exchanged water was added under stirring to the mixture at 30° C. over 10 minutes. After standing still for 3 minutes, the temperature of the mixture was started to increase, and the mixture was heated to 65° C. over 60 minutes for particle association in the mixture. In this state, a particle size of an associated particle was measured using "Multisizer 3" (manufactured by Coulter Corporation), and when a volume-based median diameter of the associated particle became 5.8 μm, the particle association was stopped by adding, to the mixture, an aqueous solution obtained by dissolving 40.2 parts by mass of sodium chloride in 1,000 parts by mass of ion-exchanged water.

After stopping the association, an aging treatment was performed by heating and stirring the resultant over 1 hour with the solution temperature kept at 70° C. to continuously fuse the associated particle, and thus a core was prepared. The average circularity of the core measured with "FPIA 2100" (manufactured by Sysmex Corporation, "FPIA" being their registered trademark) was 0.912.

(b) Preparation of Shell

Next, with the mixture kept at 65° C., 50 parts by mass of the shell resin particle was added thereto, and an aqueous solution obtained by dissolving 2 parts by mass of magnesium chloride hexahydrate in 1,000 parts by mass of ion-exchanged water was added to the mixture over 10 minutes. Thereafter, the mixture was heated to 70° C., followed by stirring over 1 hour. In this manner, the shell resin particle was fused onto the surface of the core, and then, the aging treatment was performed at 75° C. for 20 minutes to form a shell.

Thereafter, an aqueous solution obtained by dissolving 40.2 parts by mass of sodium chloride in 1,000 parts by mass of ion-exchanged water was added thereto to stop the shell formation. The resultant was cooled to 30° C. at a speed of 8° C./min. The thus generated particle was filtered, repeatedly washed with ion-exchanged water at 45° C., and then dried with warm air at 40° C., and thus, a black toner mother particle including the shell covering the surface of the core was prepared.

(c) External Additive Addition Step

An external addition treatment was performed by adding the following external additives to the black toner mother particle using "Henschel Mixer" (manufactured by Nippon Coke & Engineering Co., Ltd.) to prepare a black toner particle.

silica fine particle treated with hexamethylsilazane: 0.6 parts by mass titanium dioxide fine particle treated with n-octylsilane: 0.8 parts by mass The external addition treatment using the Henschel mixer was performed under conditions of a peripheral speed of an impeller of 35 msec, a treatment temperature of 35° C. and a treatment time of 15 minutes. Besides, the particle size of the silica fine particle of the external additive was 12 nm in terms of a volume-based median diameter, and the particle size of the titanium dioxide fine particle was 20 nm in terms of a volume-based median diameter.

[Preparation of Cyan Toner Particle]

A cyan toner particle was prepared in the same manner as in the preparation of the black toner particle except that the dispersion for cyan color was used instead of the dispersion for black color.

[Preparation of Clear Toner Particle]

A clear toner particle was prepared in the same manner as in the preparation of the black toner particle except that a surfactant aqueous solution obtained by mixing 281.5 parts by mass of ion-exchanged water and 18.5 parts by mass of sodium n-dodecyl sulfate was used instead of the dispersion for black color.

[Preparation of Ferrite Carrier Particle]

100 parts by mass of a ferrite core particle and 5 parts by mass of a copolymer resin particle of cyclohexyl methacrylate/methyl methacrylate (copolymerization ratio: 5/5) were put into a high speed mixer equipped with an impeller, and mixed by stirring at 120° C. for 30 minutes to form a resin coat layer on the surface of the ferrite core particle through function of a mechanical impact force, and thus, a ferrite carrier particle having a volume-based median diameter of 40 μm was obtained.

The volume-based median diameter of the carrier was measured using a laser diffraction particle size distribution measuring apparatus "HELOS" (manufactured by Sympatec GmbH).

1-5. Preparation of Developer

Each of a black developer, a cyan developer and a clear developer was prepared by mixing the black toner particle, the cyan toner particle or the clear toner particle with the ferrite carrier particle having a median diameter of 40 μm and having a surface coated with the copolymer of methyl methacrylate and cyclohexyl methacrylate in an amount for obtaining a toner concentration of 6 mass %

2 Image Formation and Evaluation 2-1. Image Formation

The following recording media were used:

Mu-Mat (manufactured by Hokuetsu Corporation)

Marshmallow CoC Natural (manufactured by Oji Paper Co., Ltd.)

POD Matte Coat (manufactured by Oji Paper Co., Ltd.)

Wood-free Paper OK Prince (manufactured by Oji Paper Co., Ltd.)

Kony Kent (manufactured by Lintec Corporation)

Spri C (manufactured by Nippon Paper Industries Co., Ltd.)

OK Top Coat+ (manufactured by Oji Paper Co., Ltd.)

POD Gloss Coat (manufactured by Oji Paper Co., Ltd.)

OK Trinity Navi (manufactured by Oji Paper Co., Ltd.)

Satin Kinfuji N (manufactured by Oji Paper Co., Ltd.)

Example 1

In Example 1, Mu-Mat having a weight of 157 g/m$^2$ manufactured by Hokuetsu Corporation was used as a recording medium. An arithmetic mean height Sa of a surface of the recording medium was calculated by using a whole region image obtained with a laser microscope VK-250 manufactured by Keyence Corporation using a 50× objective lens, and the thus obtained Sa was 1.137. A remodeled machine of AccurioPress C2070 manufactured by Konica Minolta, Inc. was used to output a 6 cm×6 cm patch of 100% black with sheet setting mode set to coated paper MO. The arithmetic mean height Sa of the surface of the formed resin image measured in the same manner as that of the recording medium was 0.741. While the resin image was being heated to 100° C. from a side of the rear surface thereof by using a hot plate, the resin image was rubbed with a pressing force of 10 kPa with a sponge to which ELgee neo SILVER #325 manufactured by Oike Imaging, Inc. was caused to adhere, and then the resin image was moved away from the hot plate to be air-cooled, and an excessive portion of the powder was removed using a microfiber dust cloth. The image formation was performed similarly at 130° C. and 160° C. Besides, an image was formed similarly with the color of the toner changed to cyan or clear. It is noted that ELgee neo SILVER #325 manufactured by Oike Imaging, Inc. was found to be a flat particle having a long diameter of 35 μm, a short diameter of 25 μm and a thickness of 2 μm through measurement performed using a scanning electron microscope as described above.

Examples 2 to 5 and Comparative Examples 1 to 5

An image was formed and arithmetic mean heights of a recording medium and a resin image were measured in the same manner as in Example 1 except that the recording medium and the sheet setting mode of the machine were changed as shown in Tables 1 to 3.

2-2. Evaluation

Ten expert examiners were asked to visually observe the formed images to answer whether each image had a glittering effect or a mirror-like or pearl-like effect. In Tables 1 to 3, the number of examiners who answered that the corresponding image had a glittering effect, and the number of examiners who answered that the image had a mirror-like or pearl-like effect. When eight or more examiners answered that the image had a glittering effect, the image was determined as acceptable (A), and when less than eight examiners answered that the image had a glittering effect, the image was determined as unacceptable (B).

TABLE 1

| | | | | Arithmetic | Black Toner | | | | | | | | |
|---|---|---|---|---|---|---|---|---|---|---|---|---|---|
| | | | Sheet Setting | Mean Height (Sa) of Surface of | Arithmetic Mean Height (Sa) of Surface | 100° C. | | 130° C. | | 160° C. | | |
| | Recording Medium | Weight ($g/m^2$) | Mode of Machine | Recording Medium | of Resin Layer | Glitter-ing | Mirror-like | Glitter-ing | Mirror-like | Glitter-ing | Mirror-like | Eval-uation |
| Ex. 1 | Mu-Mat | 157 | Coated Paper MO | 1.137 | 0.741 | 8 | 2 | 9 | 1 | 10 | 0 | A |
| Ex. 2 | Marshmallow CoC Natural | 209 | Wood-free Paper | 2.451 | 0.720 | 8 | 2 | 9 | 1 | 10 | 0 | A |
| Ex. 3 | POD Matte Coat | 100 | Coated Paper ML | 2.455 | 1.187 | 9 | 1 | 9 | 1 | 10 | 0 | A |
| Ex. 4 | Wood-free Paper OK Prince | 209 | Wood-free Paper | 2.993 | 1.108 | 9 | 1 | 10 | 0 | 10 | 0 | A |
| Ex. 5 | Kony Kent | 209 | Normal Paper | 3.345 | 1.580 | 10 | 0 | 10 | 0 | 10 | 0 | A |
| Comp. Ex. 1 | Spri C | 209 | Coated Paper GO | 0.416 | 0.259 | 0 | 10 | 4 | 6 | 10 | 0 | B |
| Comp. Ex. 2 | OK Top Coat+ | 158 | Coated Paper GO | 0.509 | 0.376 | 0 | 10 | 4 | 6 | 10 | 0 | B |
| Comp. Ex. 3 | POD Gloss Coat | 128 | Coated Paper GL | 0.824 | 0.615 | 0 | 10 | 5 | 5 | 10 | 0 | B |
| Comp. Ex. 4 | OK Trinity Navi | 157 | Coated Paper MO | 0.851 | 0.434 | 1 | 9 | 6 | 4 | 10 | 0 | B |
| Comp. Ex. 5 | Satin Kinfuji N | 174 | Coated Paper MO | 0.890 | 0.666 | 2 | 8 | 6 | 4 | 10 | 0 | B |

TABLE 2

| | | | | Arithmetic | Cyan Toner | | | | | | | | |
|---|---|---|---|---|---|---|---|---|---|---|---|---|---|
| | | | Sheet Setting | Mean Height (Sa) of Surface of | Arithmetic Mean Height (Sa) of Surface | 100° C. | | 130° C. | | 160° C. | | |
| | Recording Medium | Weight ($g/m^2$) | Mode of Machine | Recording Medium | of Resin Layer | Glitter-ing | Pearl-like | Glitter-ing | Pearl-like | Glitter-ing | Pearl-like | Eval-uation |
| Ex. 1 | Mu-Mat | 157 | Coated Paper MO | 1.137 | 0.721 | 8 | 2 | 9 | 1 | 10 | 0 | A |
| Ex. 2 | Marshmallow CoC Natural | 209 | Wood-free Paper | 2.451 | 0.705 | 8 | 2 | 9 | 1 | 10 | 0 | A |
| Ex. 3 | POD Matte Coat | 100 | Coated Paper ML | 2.455 | 1.166 | 9 | 1 | 9 | 1 | 10 | 0 | A |
| Ex. 4 | Wood-free Paper OK Prince | 209 | Wood-free Paper | 2.993 | 1.087 | 9 | 1 | 10 | 0 | 10 | 0 | A |
| Ex. 5 | Kony Kent | 209 | Normal Paper | 3.345 | 1.560 | 10 | 0 | 10 | 0 | 10 | 0 | A |
| Comp. Ex. 1 | Spri C | 209 | Coated Paper GO | 0.416 | 0.238 | 0 | 10 | 4 | 6 | 10 | 0 | B |
| Comp. Ex. 2 | OK Top Coat+ | 158 | Coated Paper GO | 0.509 | 0.356 | 0 | 10 | 4 | 6 | 10 | 0 | B |
| Comp. Ex. 3 | POD Gloss Coat | 128 | Coated Paper GL | 0.824 | 0.594 | 0 | 10 | 5 | 5 | 10 | 0 | B |
| Comp. Ex. 4 | OK Trinity Navi | 157 | Coated Paper MO | 0.851 | 0.413 | 1 | 9 | 6 | 4 | 10 | 0 | B |
| Comp. Ex. 5 | Satin Kinfuji N | 174 | Coated Paper MO | 0.890 | 0.646 | 2 | 8 | 6 | 4 | 10 | 0 | B |

TABLE 3

| | Recording Medium | Weight (g/m²) | Sheet Setting Mode of Machine | Arithmetic Mean Height (Sa) of Surface of Recording Medium | Arithmetic Mean Height (Sa) of Surface of Resin Layer | Clear Toner 100° C. Glittering | 100° C. Mirror-like | 130° C. Glittering | 130° C. Mirror-like | 160° C. Glittering | 160° C. Mirror-like | Evaluation |
|---|---|---|---|---|---|---|---|---|---|---|---|---|
| Ex. 1 | Mu-Mat | 157 | Coated Paper MO | 1.137 | 0.711 | 8 | 2 | 9 | 1 | 10 | 0 | A |
| Ex. 2 | Marshmallow CoC Natural | 209 | Wood-free Paper | 2.451 | 0.701 | 8 | 2 | 9 | 1 | 10 | 0 | A |
| Ex. 3 | POD Matte Coat | 100 | Coated Paper ML | 2.455 | 1.157 | 9 | 1 | 9 | 1 | 10 | 0 | A |
| Ex. 4 | Wood-free Paper OK Prince | 209 | Wood-free Paper | 2.993 | 1.078 | 9 | 1 | 10 | 0 | 10 | 0 | A |
| Ex. 5 | Kony Kent | 209 | Normal Paper | 3.345 | 1.550 | 10 | 0 | 10 | 0 | 10 | 0 | A |
| Comp. Ex. 1 | Spri C | 209 | Coated Paper GO | 0.416 | 0.229 | 0 | 10 | 4 | 6 | 10 | 0 | B |
| Comp. Ex. 2 | OK Top Coat+ | 158 | Coated Paper GO | 0.509 | 0.346 | 0 | 10 | 4 | 6 | 10 | 0 | B |
| Comp. Ex. 3 | POD Gloss Coat | 128 | Coated Paper GL | 0.824 | 0.585 | 0 | 10 | 5 | 5 | 10 | 0 | B |
| Comp. Ex. 4 | OK Trinity Navi | 157 | Coated Paper MO | 0.851 | 0.405 | 1 | 9 | 6 | 4 | 10 | 0 | B |
| Comp. Ex. 5 | Satin Kinfuji N | 174 | Coated Paper MO | 0.890 | 0.636 | 2 | 8 | 6 | 4 | 10 | 0 | B |

As is obvious from Tables 1 to 3, when the surface of the recording medium has an arithmetic mean height Sa of 1.000 or more, the number of examiners who answered the image had a glittering effect was eight or more, and hence the image was determined as acceptable no matter whether the heating temperature was 100° C., 130° C. or 160° C.

According to the present invention, an image forming method by which a supplied powder particle can be aligned to be inclined at an angle different from a horizontal direction even when a resin layer is not sufficiently softened. Accordingly, an image forming method for decorating an image can be expected to further spread by the present invention.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming method for forming a decorated image having a resin layer and a powder contacted with each other, the method comprising:

forming a resin layer on a recording medium; and supplying a powder onto the recording medium, wherein the recording medium has a surface with an arithmetic mean height Sa of 1.000 or more.

2. The image forming method according to claim 1, wherein the resin layer contains a toner particle fixed on the recording medium.

3. The image forming method according to claim 1, wherein the resin layer contains a plurality of types of toner particles fixed on the recording medium.

4. The image forming method according to claim 1, comprising softening the resin layer, wherein the powder is supplied onto a surface of the softened resin layer.

5. The image forming method according to claim 4, wherein the resin layer is softened by heating the resin layer.

6. The image forming method according to claim 4, wherein the resin layer is softened by adding a softener to the surface of the resin layer.

7. The image forming method according to claim 4, comprising aligning the powder supplied onto the surface of the resin layer.

8. The image forming method according to claim 7, wherein the powder is aligned by rubbing the surface of the resin layer onto which the powder has been supplied.

9. The image forming method according to claim 8, wherein the surface of the resin layer onto which the powder has been supplied is rubbed by a pressing member having a property to follow deformation.

10. The image forming method according to claim 4, wherein the softening of the resin layer is softening a resin layer having a surface with an arithmetic mean height Sa of 0.700 or more.

11. The image forming method according to claim 4, wherein the resin layer contains a resin in an amount added to the recording medium of 0.5 g/m² or more and 15.0 g/m² or less.

12. The image forming method according to claim 1, wherein the forming of a resin layer is performed after the supplying of a powder.

13. The image forming method according to claim 1, comprising collecting a portion of the powder not adhering to the resin layer.

14. The image forming method according to claim 1, wherein the powder contains a non-spherical particle.

15. The image forming method according to claim 1, wherein the powder contains a flat particle.

16. The image forming method according to claim 15, wherein the flat particle has a thickness of 0.2 μm or more and 3.0 μm or less.

17. The image forming method according to claim 1, wherein the powder contains a metal particle.

18. An image forming method for forming a decorated image, comprising: softening a resin layer included in a resin image including a recording medium having a surface with an arithmetic mean height Sa of 1.000 or more, and the resin layer formed on the recording medium; and supplying a powder onto a surface of the softened resin layer.

* * * * *